US007928975B2

(12) United States Patent
Park et al.

(10) Patent No.: US 7,928,975 B2
(45) Date of Patent: Apr. 19, 2011

(54) PLASMA DISPLAY AND DRIVING METHOD THEREOF

(75) Inventors: Suk-Jae Park, Suwon-si (KR); In-Ju Choi, Suwon-si (KR); Seung-Won Choi, Suwon-si (KR); Seung-Min Kim, Suwon-si (KR)

(73) Assignee: Samsung SDI Co., Ltd., Gongse-dong, Giheung-gu, Yongin-si, Gyeonggi-do (KR)

( * ) Notice: Subject to any disclaimer, the term of this patent is extended or adjusted under 35 U.S.C. 154(b) by 940 days.

(21) Appl. No.: 11/878,124

(22) Filed: Jul. 20, 2007

(65) Prior Publication Data

US 2008/0062165 A1 Mar. 13, 2008

(30) Foreign Application Priority Data

Sep. 13, 2006 (KR) ..... 10-2006-0088617

(51) Int. Cl.
*G09G 5/00* (2006.01)

(52) U.S. Cl. ..... 345/214; 345/67

(58) Field of Classification Search ..... 345/60–72, 345/204–214; 315/169.1–169.4; 313/306, 313/486, 582, 584, 586, 587
See application file for complete search history.

(56) References Cited

U.S. PATENT DOCUMENTS

| | | | | |
|---|---|---|---|---|
| 7,230,588 | B2 * | 6/2007 | Kim | 345/60 |
| 7,463,221 | B2 * | 12/2008 | Kim | 345/60 |
| 7,542,015 | B2 * | 6/2009 | Son | 345/214 |
| 2004/0212560 | A1 * | 10/2004 | Son et al. | 345/60 |
| 2005/0057447 | A1 * | 3/2005 | Son | 345/60 |
| 2005/0225509 | A1 * | 10/2005 | Choi et al. | 345/60 |
| 2006/0097963 | A1 * | 5/2006 | Lee | 345/63 |
| 2006/0158386 | A1 * | 7/2006 | Kim | 345/60 |
| 2006/0158387 | A1 * | 7/2006 | Kim | 345/60 |
| 2006/0232512 | A1 * | 10/2006 | Kim | 345/60 |
| 2006/0273989 | A1 * | 12/2006 | Kim et al. | 345/67 |
| 2007/0008249 | A1 * | 1/2007 | Ito et al. | 345/67 |

FOREIGN PATENT DOCUMENTS

| | | | |
|---|---|---|---|
| KR | 1020040007710 | A | 1/2004 |
| KR | 2004-0091878 | A | 11/2004 |
| KR | 2006-0042268 | A | 5/2006 |
| KR | 100708859 | B1 | 4/2007 |

* cited by examiner

*Primary Examiner* — Amare Mengistu
*Assistant Examiner* — Dmitriy Bolotin
(74) *Attorney, Agent, or Firm* — Robert E. Bushnell, Esq.

(57) ABSTRACT

In a plasma display and a driving method thereof, a misfiring prevention period is provided between a reset period and an address period in response to a temperature of the plasma display being higher than predetermined temperature or a weight value of a previous subfield being higher than a predetermined weight value. In the misfiring prevention period, a first voltage higher than a voltage supplied to a sustain electrode is supplied during a first period, and a voltage at a scan electrode is gradually decreased from a second voltage to a third voltage during a second period subsequent to the first period.

18 Claims, 7 Drawing Sheets

PLASMA DISPLAY AND DRIVING METHOD THEREOF

CLAIM OF PRIORITY

This application makes reference to, incorporates the same herein, and claims all benefits accruing under 35 U.S.C.§119 from an application for PLASMA DISPLAY AND DRIVING METHOD THEREOF earlier filed in the Korean Intellectual Property Office on the 13$^{th}$ of Sep. 2006 and there duly assigned Serial No. 10-2006-0088617.

BACKGROUND OF THE INVENTION

1. Field of the Invention

The present invention relates to a plasma display and a driving method thereof.

2. Description of the Related Art

A Plasma Display Panel (PDP) is a flat panel display that uses a plasma generated by a gas discharge to display characters or images. It includes, depending on its size, more than several scores to millions of pixels arranged in a matrix pattern.

In the plasma display, one frame is divided into a plurality of subfields, each having a weight value, and a grayscale is embodied by performing time-divisional control of the subfields. Each subfield includes a reset period, an address period, and a sustain period. The reset period is a period of initializing a state of each cell so as to smoothly perform an address operation in a cell, and the address period is a period of selecting a cell among a plurality of cells to emit light through an address discharge. In addition, the sustain period is a period of performing a sustain discharge in a cell to emit light.

In a method for expressing grayscales in the plasma display, an address operation is sequentially performed from a first scan electrode line to a last scan electrode line during the address period. Then, a sustain discharge operation is simultaneously performed for all cells during the sustain period. According to the above driving method, since the address operation of the cell corresponding to the scan electrode in which the address operation is performed at a former half period is performed after the address period is performed in the cell at a latter half period, wall charges formed after the reset period may flow to a discharge space. Accordingly, the address operation is unstably performed toward the last scan electrode line, and therefore a low discharge may be generated when performing the sustain discharge. Particularly, when the temperature of the PDP is high or a weight value of a previous subfield is higher, the low discharge may be well generated since there are many priming particles in the discharge space of the PDP.

SUMMARY OF THE INVENTION

The present invention has been made in an effort to provide a plasma display for stably performing an address discharge, and a driving method thereof.

In an exemplary method of driving a plasma display including a first electrode, a second electrode, and a third electrode crossing the first and second electrodes, a temperature of the plasma display is detected and a misfiring prevention period is provided between a reset period and an address period in response to the detected temperature of the plasma display being higher than a predetermined temperature. In the misfiring prevention period, a first voltage higher that a voltage supplied to the second electrode is supplied to the first electrode during a first period, and a voltage at the first electrode is gradually decreased from a second voltage to a third voltage during a second period.

In another exemplary method of driving a plasma display including a first electrode, a second electrode, and a third electrode crossing the first and second electrodes, in a misfiring prevention period between a reset period and an address period, a first voltage higher than a voltage supplied to the second electrode is supplied to the first electrode during a first period, and a voltage at the first electrode is gradually decreased from a second voltage to a third voltage during a second period. The misfiring prevention period is provided in response to a weight value of a previous subfield being higher than a predetermined weight value.

An exemplary plasma display according to an embodiment of the present invention includes a Plasma Display Panel (PDP), a temperature detector, a controller, and a driver. The PDP includes a first electrode, a second electrode, and a third electrode crossing the first and second electrodes. The temperature detector detects the temperature of the PDP. The controller controls a driver to provide a misfiring prevention period between a reset period and an address period in response to the detected temperature of the PDP being higher than a predetermined temperature or a weight value of a previous subfield being higher than a predetermined weight value. In the misfiring prevention period, the driver respectively supplies a first voltage and a second voltage lower than the first voltage to the first and second electrodes during a first period, and gradually decreases a voltage at the first electrode from a third voltage to a fourth voltage during a second period.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

Figure 1:
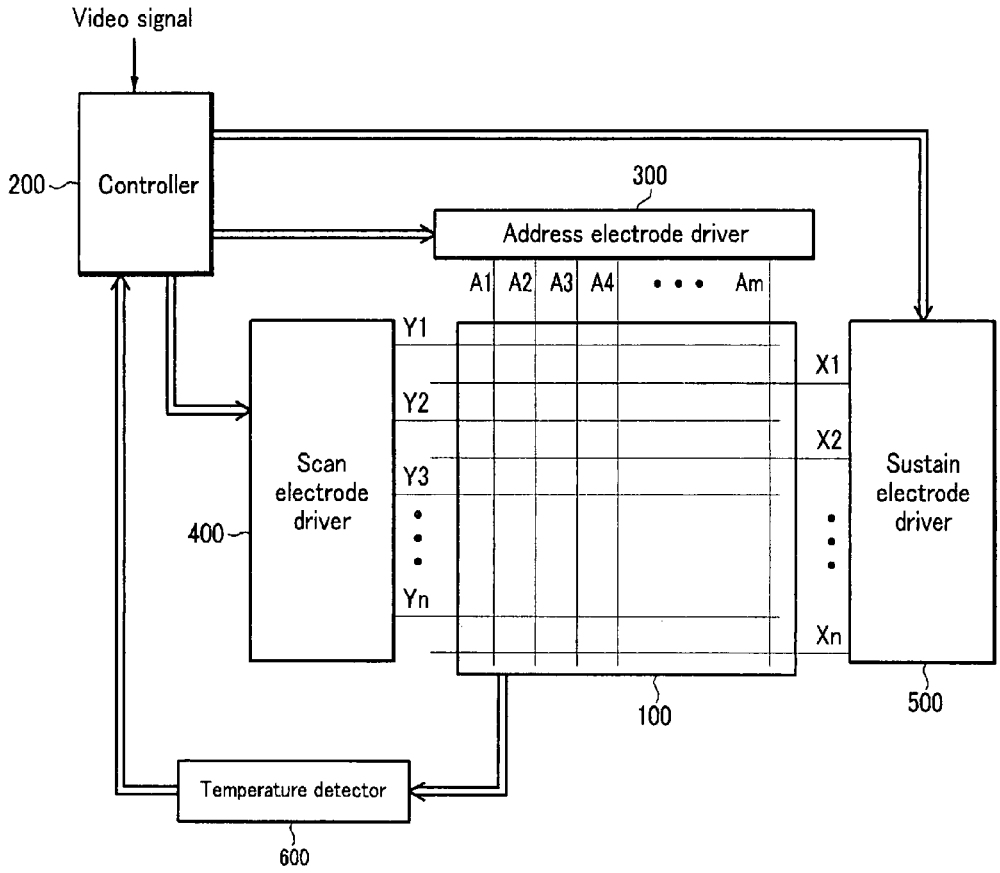
FIG. 1 is a block diagram of a plasma display according to a first exemplary embodiment of the present invention.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

Throughout the specification, a wall charge refers to a charge formed near each electrode on a wall (e.g., a dielectric layer) of a cell. The wall charge does not actually contact the electrodes, but in the specification, it will be described such that wall charges are formed or accumulated on the electrodes. In addition, unless explicitly described to the contrary, the word "comprise" and variations such as "comprises" or "comprising" will be understood to imply the inclusion of stated elements but not the exclusion of any other elements.

A plasma display according to a first exemplary embodiment of the present invention is described below with reference to FIG. 1 to FIG. 2.

FIG. 1 is a block diagram of the plasma display according to the first exemplary embodiment of the present invention.

As shown in FIG. 1, the plasma display according to the first exemplary embodiment of the present invention includes a Plasma Display Panel (PDP) 100, a controller 200, an address electrode driver 300, a scan electrode driver 400, a sustain electrode driver 500, and a temperature detector 600.

The PDP 100 includes a plurality of address electrodes A1-Am that extend in a column direction, and a plurality of sustain electrodes X1-Xn and a plurality of scan electrodes Y1-Yn that extend in a row direction. The plurality of scan electrodes Y1-Yn and sustain electrodes X1-Xn are formed and arranged in pairs. Discharge cells are formed by adjacent scan electrodes and sustain electrodes and address electrodes intersecting thereto. The structure of the PDP 100 is merely an example, and a panel having other structures that can supply a driving waveform to be described later can be supplied to the present invention.

The controller 200 receives an external video signal, and outputs an A electrode driving control signal, an X electrode driving control signal, and a Y electrode driving control signal. In the controller 200, one frame is driven by dividing it into a plurality of subfields, and each subfield includes a reset period, an address period, and a sustain period according to a sequential operation change. In the first exemplary embodiment of the present invention, a misfiring prevention period is provided between the reset period and the address period according to the temperature of the PDP 100.

The address electrode driver 300 receives the A electrode driving control signal from the controller 200 to supply a display data signal for selecting a desired discharge cell to the A electrode.

The scan electrode driver 400 receives the Y electrode driving control signal from the controller 200 to supply a driving voltage to the Y electrode.

The sustain electrode driver 500 receives the X electrode driving control signal from the controller 200 to supply the driving voltage to the X electrode.

The temperature detector 600 detects the temperature of the PDP 100 and transmits it to the controller 200.

Figure 2:
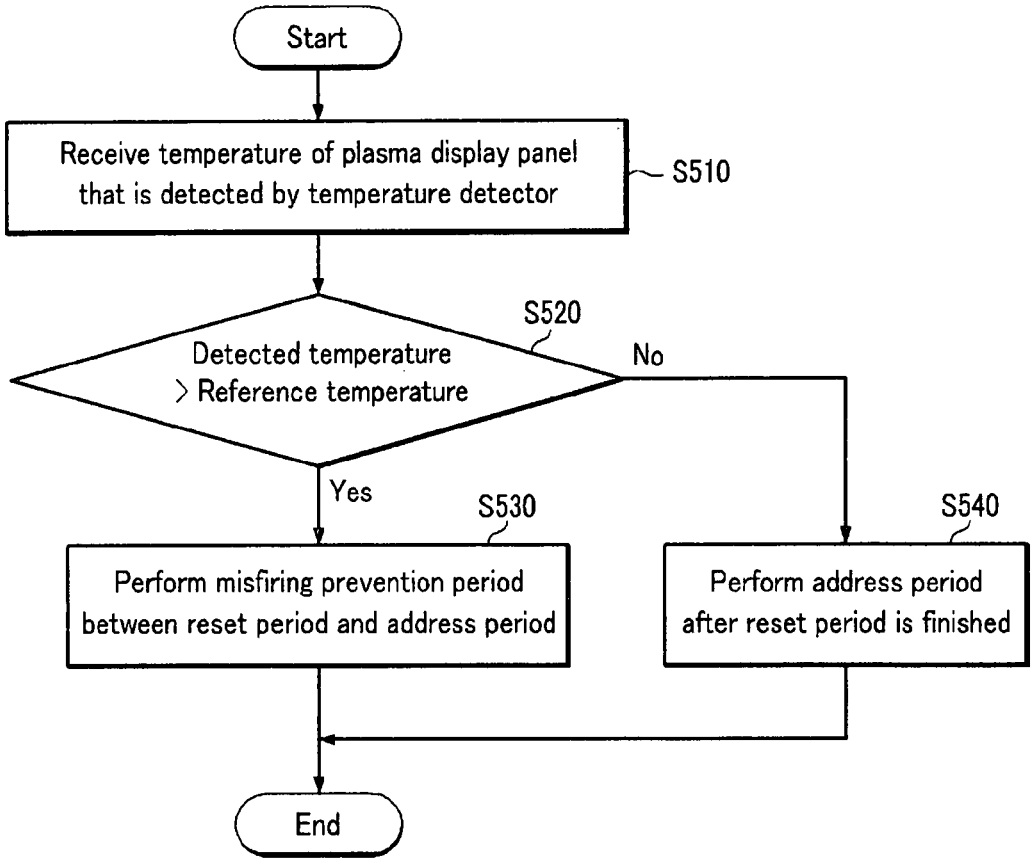
FIG. 2 is a flowchart of the operation of the controller 200 of FIG. 1.

FIG. 2 is a flowchart of the operation of the controller 200 of FIG. 1.

As shown in FIG. 2, the controller 200 receives the temperature of the PDP 100 detected by the temperature detector 600 in step S510, and compares it with a reference temperature in step S520.

Figure 5:
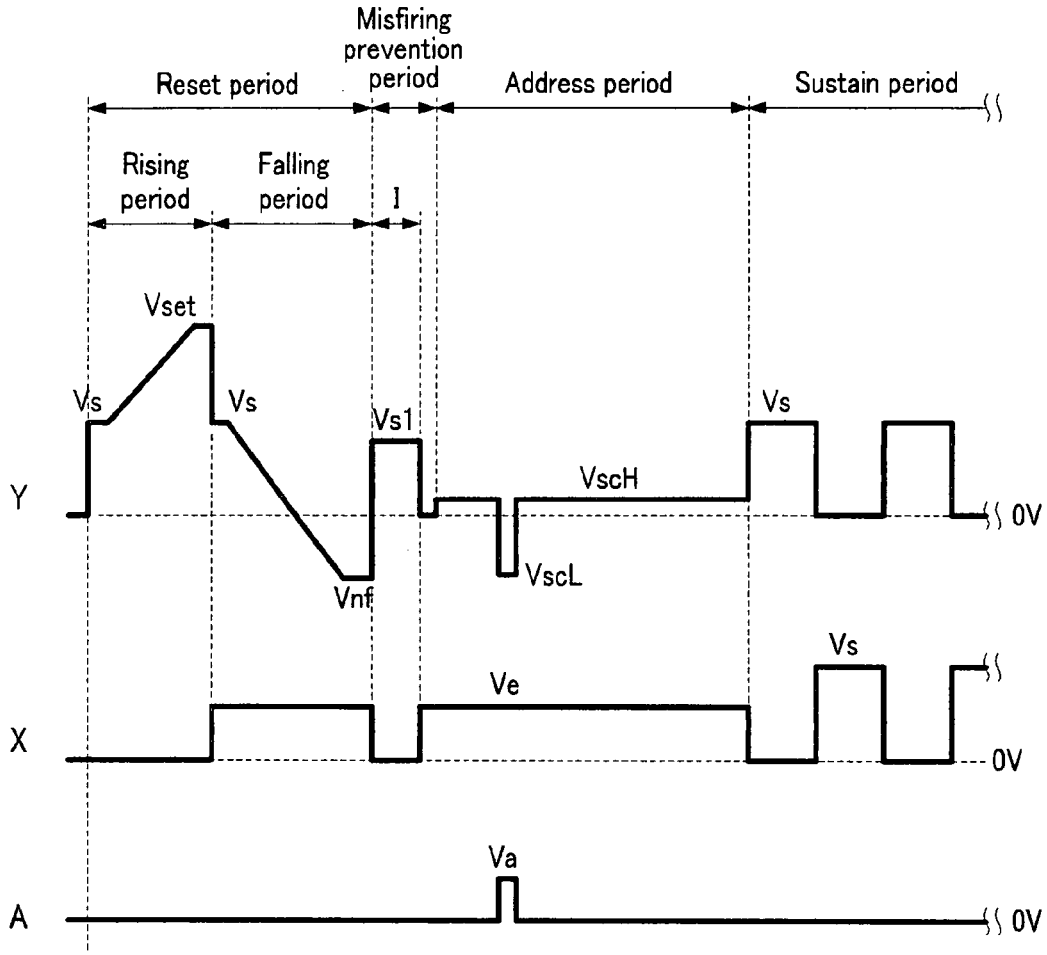
FIG. 5 are waveforms of driving signals supplied to the plasma display according to the first or second exemplary embodiments of the present invention.
Figure 6:
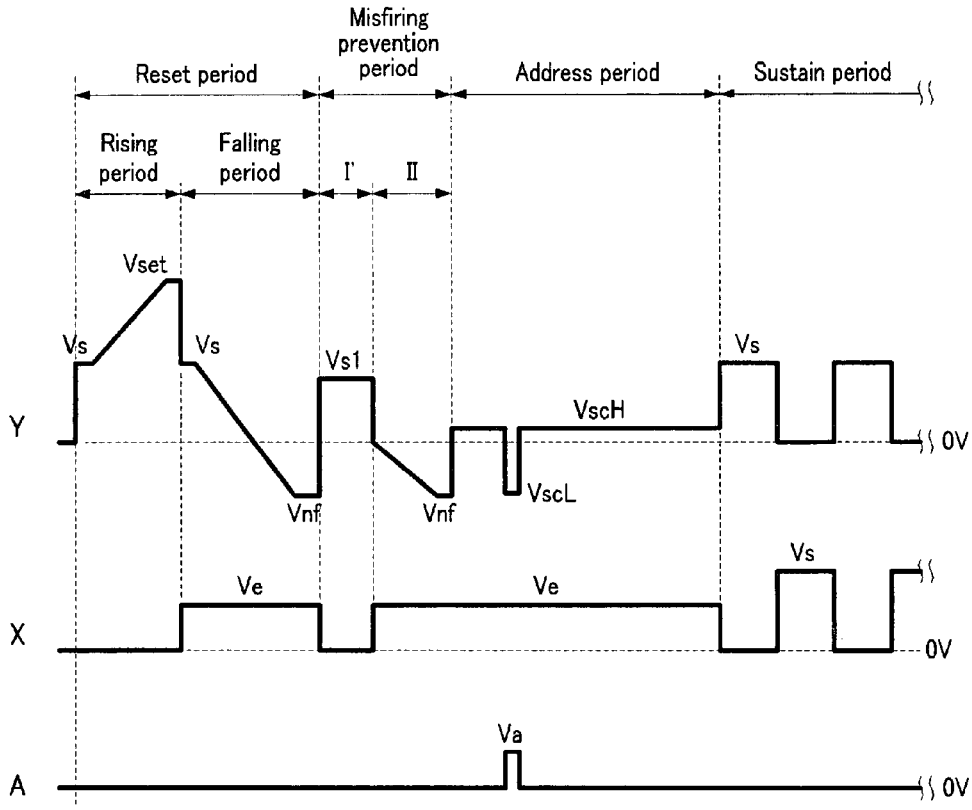
FIG. 6 is a second example of waveforms of driving signals supplied to the plasma display according to the first or second exemplary embodiments of the present invention.
Figure 7:
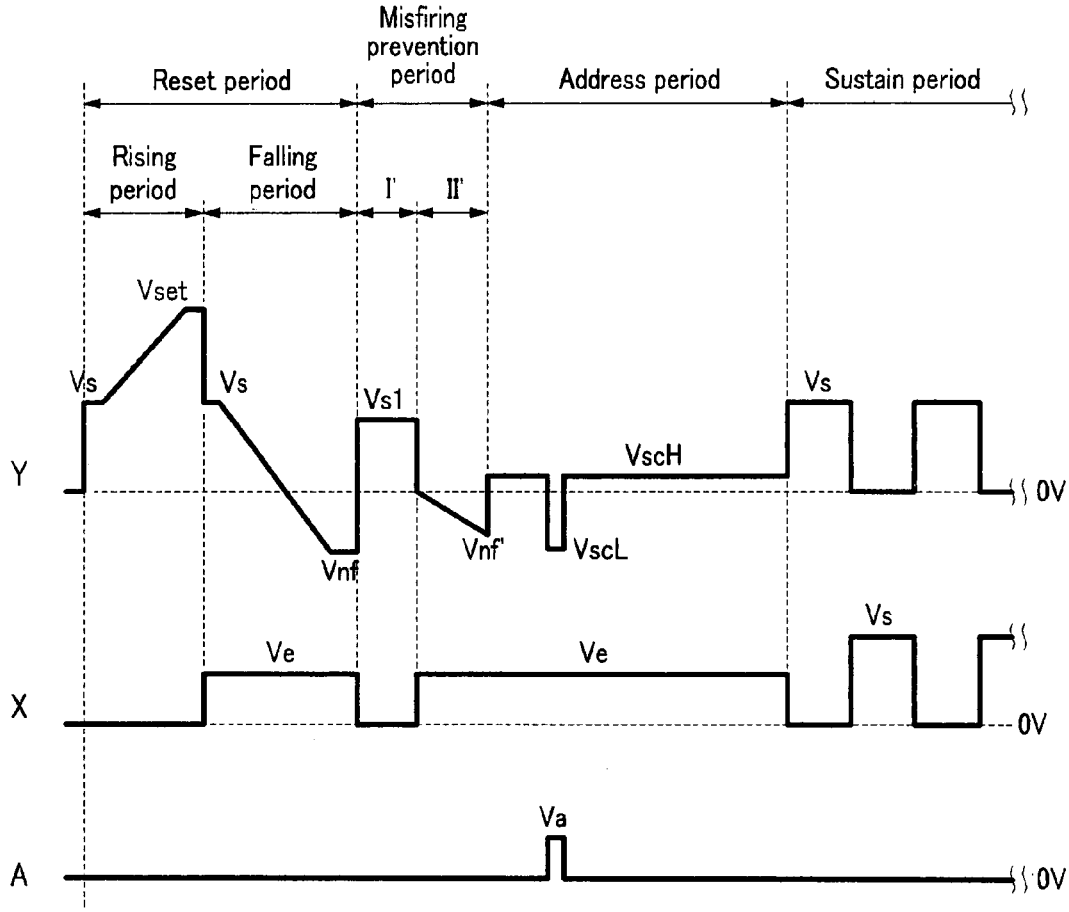
FIG. 7 is a third example of waveforms of driving signals supplied to the plasma display according to the first or second exemplary embodiments of the present invention.

In this case, the controller 200 generates a control signal for performing the misfiring prevention period between the reset period and the address period in step S530 when the temperature of the PDP 100 is greater than the reference temperature. That is, driving waveforms of FIG. 5 to FIG. 7 are supplied to the Y electrode.

In addition, the controller 200 generates the control signal for performing the address period directly after the reset period in step S540 when the temperature of the PDP 100 is less than the reference temperature. The reference temperature is a temperature for generating a low discharge since there are a large number of priming particles in the discharge space in the PDP 100, which may be experimentally determined. Generally, the reference temperature may be set to be 25 degrees, but another temperature may be set as the reference temperature.

The plasma display according to a second exemplary embodiment of the present invention is described below with reference to FIG. 3 and FIG. 4.

Figure 3:
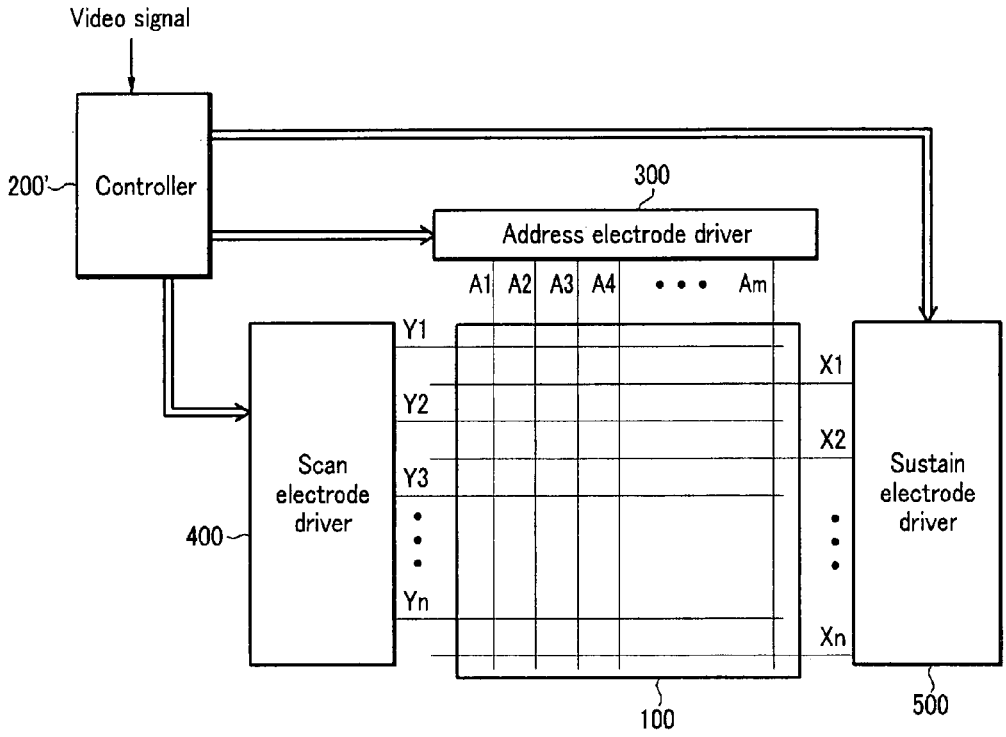
FIG. 3 is a block diagram of a plasma display according to a second exemplary embodiment of the present invention.

FIG. 3 is a block diagram of the plasma display according to the second exemplary embodiment of the present invention.

As shown in FIG. 3, the plasma display according to the second exemplary embodiment of the present invention includes the Plasma Display Panel (PDP) 100, the controller 200', the address electrode driver 300, the scan electrode driver 400, and the sustain electrode driver 500. The plasma display of FIG. 3 is similar to that of FIG. 1 except that the controller 200' generates the control signal for performing the misfiring prevention period according to the number of sustain discharge generations during the sustain period of a previous subfield, and therefore, descriptions of parts that already have been described will be omitted. In addition, differing from FIG. 1, the plasma display does not include the temperature detector 600 of FIG. 3.

In more detail, the controller 200' receives the external video signal, and outputs the A electrode driving control signal, the X electrode driving control signal, and the Y electrode driving control signal. In addition, the controller 200' divides one frame into a plurality of subfields, and each subfield includes the reset period, the address period, and the sustain period. The misfiring prevention period is provided between the reset period and the address period according to a weight value of a previous subfield.

Figure 4:
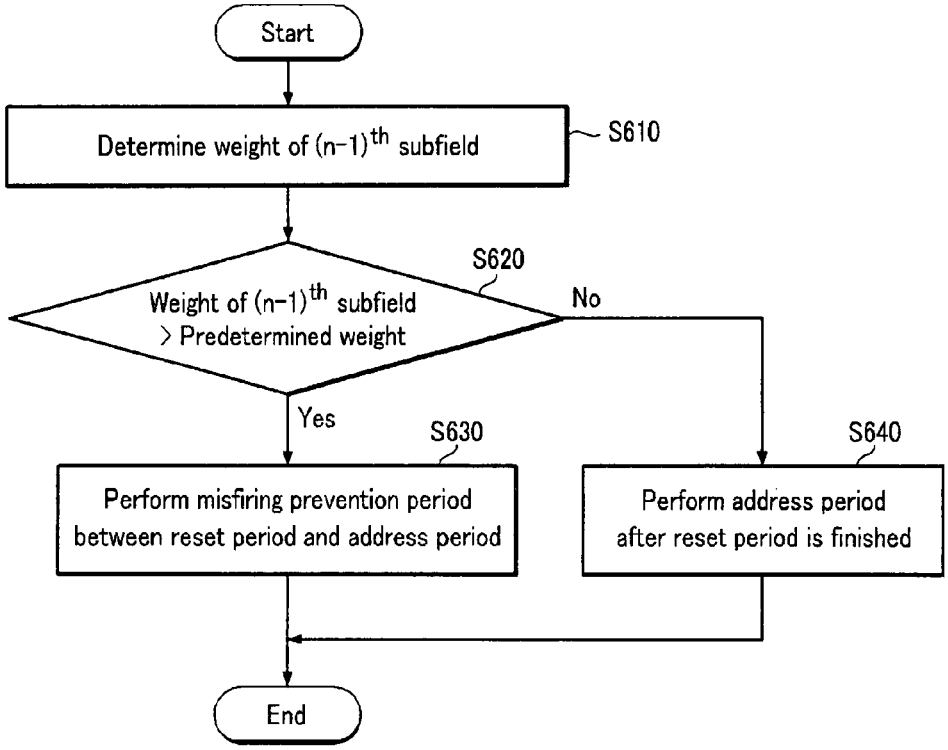
FIG. 4 is a flowchart of the operation of the controller 200' of FIG. 3.

FIG. 4 is a flowchart of the operation of the controller 200' of FIG. 3.

To perform an operation of an $N^{th}$ subfield, as shown in FIG. 4, the controller 200' determines the weight value of an $(N-1)^{th}$ subfield in step S610.

Then, the controller 200' compares the weight value of the $(N-1)^{th}$ subfield to a predetermined weight value in step S620.

The controller 200' generates the control signal for performing the misfiring prevention period between the reset period and the address period in step S630 when the weight value of the $(N-1)^{th}$ subfield is higher than the predetermined weight value. That is, the driving waveforms of FIG. 5 to FIG. 7 are supplied to the Y electrode.

In addition, the controller 200' generates the control signal for performing the address period directly after the reset period in step S640 when the weight value of the $(N-1)^{th}$ subfield is less than the predetermined weight value. The predetermined weight value is a weight value for generating the low discharge since there are a large number of priming particles in the discharge space in the PDP 100, which may be experimentally determined.

The large number of priming particles exist not only when the weight value of the $(N-1)^{th}$ subfield is higher than the predetermined weight value, but also when the temperature of the PDP 100 is higher than the reference temperature. Accordingly, the plasma display according to the second exemplary embodiment of the present invention may further include the temperature detector 600, and the controller 200' may generate the control signal for performing the misfiring prevention period according to the weight value of the $(n-1)^{th}$ subfield or the temperature of the PDP 100.

The driving waveforms supplied when the temperature of the PDP 100 is higher than the reference temperature or the weight value of the previous subfield is higher will are described below with reference to FIG. 5 to FIG. 7. For a better understanding and ease of description, only the driving waveforms supplied to the Y, X, and A electrodes forming one cell are described.

FIG. 5 is an example of the driving waveforms supplied to the plasma display according to the first or second exemplary embodiment of the present invention. That is, the driving waveforms are supplied to the plasma display when the weight value of the previous subfield is higher or the temperature of the PDP 100 is higher than the reference temperature as described with reference to FIG. 1 to FIG. 4. As shown in FIG. 5, each subfield includes the reset period, the misfiring prevention period, the address period, and the sustain period. In addition, the reset period includes a rising period and a falling period.

While maintaining the A and X electrodes at a reference voltage (0V in FIG. 5) during the rising period of the reset period, a voltage at the Y electrode is gradually increased from a Vs voltage to a Vset voltage. When the voltage at the Y electrode increases, a weak discharge is generated between the Y electrode and the X electrode and between the Y electrode and the A electrode, (−) wall charges are formed on the Y electrode, and (+) wall charges are formed on the X and A electrodes. Since the weak discharge is generated when the voltage at the Y electrode is gradually increased, the wall charges are formed such that a sum of an external voltage and a wall voltage of the cell is maintained in a discharge firing voltage (Vf) state. The Vset voltage is high enough to discharge the cells in each condition since it is necessary to initialize all cells during the reset period. In addition, in FIG. 5, the voltage at the Y electrode increases or decreases in a ramp pattern. However, gradually increasing or decreasing waveforms may also be supplied.

During the falling period of the reset period, while respectively maintaining the A electrode and the X electrode and the reference voltage and a Ve voltage, the voltage at the Y electrode is gradually decreased from the Vs voltage to a Vnf voltage. When the voltage at the Y electrode decreases, the weak discharge is generated between the Y electrode and the X electrode and between the Y electrode and the A electrode, and the (−) wall charges formed on the Y electrode and the (+) wall charges formed on the X and A electrodes during the rising period are eliminated. Accordingly, the (−) wall charges of the Y electrode are reduced, and the (+) wall charges of the X electrode are reduced. In addition, the (+) wall charges of the A electrode are appropriately reduced to perform the address operation. Generally, a voltage of (Vnf−Ve) is set close to a discharge firing voltage between the Y electrode and the X electrode. Accordingly, since the wall voltage between the Y electrode and the X electrode is almost 0V, the cell in which an address discharge has not been generated during the address period is prevented from misfiring during the sustain period.

During the address period, to select the light emitting cell, while supplying the Ve voltage to the X electrode, a scan pulse having a VscL voltage (i.e., a scan voltage) is sequentially supplied to the plurality of Y electrodes. In addition, a Va voltage is supplied to the A electrode passing the light emitting cell among the plurality of cells formed by the Y electrode to which the VscL voltage is supplied. Thereby, the address discharge is generated between the A electrode receiving the Va voltage and the Y electrode receiving the VscL voltage and between the Y electrode receiving the VscL voltage and the X electrode receiving the Ve voltage, and therefore the (+) wall charges are formed on the Y electrode and the (−) wall charges are formed on the A and X electrodes. The VscL voltage may be set to be equal to or less than the Vnf voltage. In addition, a VscH voltage (i.e., a non-scan voltage) that is higher than the VscL voltage is supplied to the Y electrode to which the VscL voltage is not supplied, and the reference voltage is supplied to the A electrode of the discharge cell that is not selected.

Subsequently, during the sustain period, a sustain pulse alternately having a high level voltage (the Vs voltage in FIG. 5) and a low level voltage (the 0V in FIG. 5) is supplied to the Y and X electrodes. The sustain pulse supplied to the Y electrode has an opposite phase to that supplied to the X electrode. That is, the 0V voltage is supplied to the X electrode when the Vs voltage is supplied to the Y electrode, and the 0V voltage is supplied to the Y electrode when the Vs voltage is supplied to the X electrode. A discharge is generated between the Y and X electrodes by the Vs voltage and the wall voltage formed between the Y and X electrodes by the address discharge. Subsequently, a process for supplying the sustain pulse to the Y and X electrodes is repeatedly performed a number of times corresponding to the weight value of the corresponding subfield.

In addition, the priming particles are increased on the discharge space of the PDP 100 when the temperature of the PDP becomes high or when the weight value of the previous subfield is high. Accordingly, the wall charges formed on the respective electrodes while the address operation is being performed through all of the Y electrode lines during the address period are eliminated in the discharge space. Therefore, the misfiring prevention period for compensating the eliminated wall charges during the address period by further accumulating the wall charges to the Y electrode after the reset period is performed.

According to the first and second exemplary embodiments of the present invention, during a first period I of the misfiring prevention period, a Vs1 voltage that is higher than the reference voltage is supplied to the Y electrode while supplying the reference voltage (the 0V voltage in FIG. 5) to the X electrode, and therefore the (−) wall charges are further accumulated on the Y electrode. The reference voltage has been supplied to the A electrode. In further detail, when the Vs1 voltage is supplied to the Y electrode, (−) charges among space charges move toward the Y electrode to which a voltage that is higher than the X and A electrodes is supplied. As described, since the (−) charges are further accumulated on the Y electrode, the wall voltage is maintained between the Y electrode and the A electrode even when the wall charges are lost during the address period, and therefore the address discharge may be stably performed. In FIG. 5, the Vs1 voltage that is lower than the Vs voltage is supplied to the Y electrode during the first period I. However, the present invention is not limited thereto, and another voltage may be supplied if it does not generate a subsequent sustain discharge without the address discharge. In addition, the (−) charges may be further accumulated on the Y electrode by supplying the Ve voltage to the X electrode during the first period I to maintain a voltage difference between the Y electrode. The wall charges of the Y electrode may be more efficiently compensated as a time for maintaining the Vs1 voltage at the Y electrode increases.

Furthermore, when the time for maintaining the Vs1 voltage at the Y electrode increases too much, excessive (−) wall charges are formed on the Y electrode. When the excessive (−) wall charges are formed on the Y electrode, misfiring may occur in the cell performing the address operation at the former half period. A driving method for stably performing the sustain discharge by partially eliminating the wall charges that are excessively formed on the Y electrode during the misfiring prevention period is described below.

FIG. 6 is a second example of the driving waveforms supplied to the plasma display according to the first or the second exemplary embodiment of the present invention, and FIG. 7 is a third example of the driving waveforms supplied to the plasma display according to the first or the second exemplary embodiment of the present invention. The driving waveforms and method of FIG. 6 and FIG. 7 are similar to those of FIG. 5 except for the driving waveforms supplied to the Y electrode during the misfiring prevention period, and therefore, descriptions of previously described parts have been omitted.

Unlike FIG. 5, the Vs1 voltage is supplied to the Y electrode during a second period I' of the misfiring prevention period that is longer than the first period I in FIG. 6. Subsequently, the waveform gradually decreasing from the reference voltage (the 0V voltage in FIG. 6) to the Vnf voltage is supplied to the Y electrode during a third period II. The waveform gradually decreasing from the Vs1 voltage may be supplied to the Y electrode. In addition, in FIG. 6, the voltage at the Y electrode is decreased in a ramp pattern. However, another type of gradually decreasing waveform may be supplied.

In further detail, the Vs1 voltage is supplied to the Y electrode while the reference voltage is supplied to the X electrode during the second period I'. Compared to the (−) wall charges accumulated during the first period I of FIG. 5, more (−) wall charges are accumulated to the Y electrode receiving the relatively higher voltage. Subsequently, while the Ve voltage is supplied to the X electrode and is maintained at the X electrode during the third period II, the voltage at the Y electrode is gradually decreased from the reference voltage to the Vnf voltage. Accordingly, the (−) wall charges excessively accumulated on the Y electrode during the second period I' are eliminated during the third period II.

In FIG. 7, while supplying the reference voltage (the 0V voltage in FIG. 7) to the X electrode during the second period I', the Vs1 voltage is supplied to the Y electrode. Compared to the (−) wall charges accumulated during the first period I shown in FIG. 5, more (−) wall charges are accumulated on the Y electrode to which the relatively high voltage is supplied. Subsequently, while supplying the Ve voltage to the X electrode during a fourth period II', the voltage at the Y electrode is gradually decreased from the reference voltage to the Vnf' voltage. Accordingly, the (−) wall charges that are excessively accumulated on the Y electrode during the second period I' are eliminated during the fourth period II'. Since the Vnf' voltage that is higher than the Vnf voltage and the fourth period II' is reduced to be shorter than the third period II of FIG. 6, time efficiency may be increased.

While this invention has been described in connection with what is presently considered to be practical exemplary embodiments, it is to be understood that the present invention is not limited to the disclosed embodiments, but, on the contrary, is intended to cover various modifications and equivalent arrangements included within the spirit and scope of the appended claims.

According to the exemplary embodiments of the present invention, since the wall charges that may be eliminated by the weight value of the previous subfield or the high temperature are compensated for and the address discharge is stably performed, the low discharge and the misfiring are prevented.

What is claimed is:

1. A method of driving a plasma display including a first electrode, a second electrode, and a third electrode crossing the first and second electrodes, the method comprising:

detecting a temperature of the plasma display; and providing a misfiring prevention period between a reset period and an address period in response to the detected temperature of the plasma display being higher than a predetermined temperature;

wherein, in the misfiring prevention period, a first voltage higher that a voltage supplied to the second electrode is supplied to the first electrode during a first period, and a voltage at the first electrode is gradually decreased from a second voltage to a third voltage during a second period subsequent to the first period.

2. The method of claim 1, wherein a ground voltage lower than the first voltage is supplied to the third electrode during the first period.

3. The method of claim 2, wherein the first voltage is higher than a non-scan voltage supplied to the first electrode during the address period.

4. The method of claim 3, wherein the second voltage is equal to the ground voltage.

5. The method of claim 3, wherein the third voltage is higher than a final voltage supplied to the first electrode during the reset period.

6. The method of claim 1, wherein the address period is subsequent to the reset period in response to the temperature of the plasma display being lower than the predetermined temperature.

7. A method of driving a plasma display including a first electrode, a second electrode, and a third electrode crossing the first and second electrodes, the method comprising, in a misfiring prevention period between a reset period and an address period:

supplying a first voltage to the first electrode higher than a voltage supplied to the second electrode during a first period; and gradually decreasing a voltage at the first electrode from a second voltage to a third voltage during a second period subsequent to the first period;

wherein the misfiring prevention period is provided in response to a weight value of a previous subfield being higher than a predetermined weight value.

8. The method of claim 7, wherein a ground voltage lower than the first voltage is supplied to the third electrode during the first period.

9. The method of claim 8, wherein the first voltage is higher than a non-scan voltage supplied to the first electrode during the address period.

10. The method of claim 9, wherein the second voltage is equal to the ground voltage.

11. The method of claim 9, wherein the third voltage is higher than a final voltage supplied to the first electrode during the reset period.

12. The method of claim 7, wherein the address period is subsequent to the reset period in response to the weight value of the previous subfield being lower than the predetermined weight value.

13. A plasma display comprising:

a Plasma Display Panel (PDP) including a first electrode, a second electrode, and a third electrode crossing the first and second electrodes;

a temperature detector to detect a temperature of the PDP;

a driver to drive the PDP; and a controller to control the driver to provide a misfiring prevention period between a reset period and an address period in response to the detected temperature of the PDP being higher than predetermined temperature or a weight value of a previous subfield being higher than a predetermined weight value; and wherein the driver, in the misfiring prevention period, respectively supplies a first voltage and a second voltage lower than the first voltage to the first and second electrodes during a first period, and gradually decreases a voltage at the first electrode from a third voltage to a fourth voltage during a second period subsequent to the first period.

14. The plasma display of claim 13, wherein the controller controls the driver to supply a ground voltage lower than the first voltage to the third electrode during the first period.

15. The plasma display of claim 14, wherein the first voltage is higher than a non-scan voltage supplied to the first electrode during the address period.

16. The plasma display of claim 15, wherein the third voltage is equal to the ground voltage.

17. The plasma display of claim 15, wherein the fourth voltage is higher than a final voltage supplied to the first electrode during the reset period.

18. The plasma display of claim 13, wherein the controller controls the driver to provide the address period directly after the reset period in response to the detected temperature of the ADP being lower than the predetermined temperature or the weight value of the previous subfield being lower than the predetermined weight value.

* * * * *